US010753311B2

(12) United States Patent
Shin

(10) Patent No.: US 10,753,311 B2
(45) Date of Patent: Aug. 25, 2020

(54) PISTON FOR INTERNAL COMBUSTION ENGINE

(71) Applicants: HYUNDAI MOTOR COMPANY, Seoul (KR); KIA MOTORS CORPORATION, Seoul (KR)

(72) Inventor: Myung Sub Shin, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/511,868

(22) Filed: Jul. 15, 2019

(65) Prior Publication Data

US 2020/0173394 A1 Jun. 4, 2020

(30) Foreign Application Priority Data

Dec. 3, 2018 (KR) ..... 10-2018-0153850

(51) Int. Cl.

| | |
|---|---|
| ***F02F 3/22*** | (2006.01) |
| ***F02F 3/00*** | (2006.01) |
| ***F02F 3/12*** | (2006.01) |

(52) U.S. Cl.

CPC ..... *F02F 3/22* (2013.01); *F02F 3/003* (2013.01); *F02F 3/0015* (2013.01); *F02F 3/12* (2013.01); *F02F 2003/0061* (2013.01)

(58) Field of Classification Search

CPC .... F02F 3/22; F02F 3/0015; F02F 3/12; F02F 2200/00; F02F 2003/0061; F02F 3/003

See application file for complete search history.

(56) References Cited

U.S. PATENT DOCUMENTS

| | | | | |
|---|---|---|---|---|
| 1,479,816 A * | 1/1924 | Jorgensen | ..... | F02F 3/0023 123/41.35 |
| 2019/0010892 A1* | 1/2019 | Lapp | ..... | F02F 3/003 |

* cited by examiner

*Primary Examiner* — Syed O Hasan

(74) *Attorney, Agent, or Firm* — Brinks Gilson & Lione

(57) ABSTRACT

A piston for an internal combustion engine includes: a crown; a skirt extending from the crown; an oil gallery extending annularly within the crown, and having an inlet and an outlet; and a structure mounted at the outlet of the oil gallery to induce oil shaking.

10 Claims, 11 Drawing Sheets

PISTON FOR INTERNAL COMBUSTION ENGINE

CROSS-REFERENCE TO RELATED APPLICATION

This application claims priority to and the benefit of Korean Patent Application No. 10-2018-0153850, filed on Dec. 3, 2018, the entire contents of which are hereby incorporated by reference.

FIELD

The present disclosure relates to a piston for an internal combustion engine capable of improving cooling efficiency.

BACKGROUND

The statements in this section merely provide background information related to the present disclosure and may not constitute prior art.

A piston for an internal combustion engine is a component that reciprocates in a cylinder with explosive force from expanding combustion gas in the cylinder to transfer rotational force to a crankshaft via a connecting rod. The piston for an internal combustion engine has an oil gallery formed therein. As oil circulates through the oil gallery, the piston may appropriately be cooled so that overheating of the piston may be prevented. The oil may be supplied by an oil jet to the inner wall surface of the cylinder and the oil gallery of the piston.

The oil gallery may have an inlet for receiving oil injected by the oil jet, and an outlet for discharging oil. However, the oil circulating in the oil gallery during the operation of the engine may be discharged through the outlet of the oil gallery before a sufficient cooling effect is produced. Since the outlet of the oil gallery is the farthest portion from the inlet of the oil gallery, it may be the most vulnerable in terms of the oil cooling effect Meanwhile, as the piston moves up and down during the operation of the engine, the oil circulating in the oil gallery may be shaken along the axial direction of the piston inside the oil gallery. That is, oil shaking may occur.

However, we have discovered that the outlet of the oil gallery is open to the outside, so oil shaking does not occur at the outlet of the oil gallery. This may lead to the highest temperature on the top surface of the oil gallery facing the outlet of the oil gallery, resulting in reduced durability. Thus, there is a high probability of cracking in the top surface facing the outlet of the oil gallery, and such cracking of the piston may cause scuffing on the skirt of the piston.

The above information described in this background section is provided to assist in understanding the background of the inventive concept, and may include any technical concept which is not considered as the prior art that is already known to those skilled in the art.

SUMMARY

An aspect of the present disclosure provides a piston for an internal combustion engine, capable of inducing the occurrence of oil shaking at the outlet side of an oil gallery during the operation of the engine, thereby improving cooling efficiency at the outlet of the oil gallery.

According to an aspect of the present disclosure, a piston for an internal combustion engine may include: a crown; a skirt extending from the crown; an oil gallery extending annularly within the crown, and having an inlet and an outlet; and a structure mounted at the outlet of the oil gallery to induce oil shaking.

The structure may have a body mounted at the outlet of the oil gallery, and one or more communication holes formed in a lateral wall of the body, and the communication holes may allow oil to be discharged therethrough.

The body may have an end wall on a top end thereof, and the end wall may directly face a top wall of the oil gallery so that a shaking space inducing oil shaking may be defined between the end wall of the body and the top wall of the oil gallery.

The end wall may have at least one recess.

The communication holes may have a slot shape extending in a length direction of the body.

The communication holes may have a circular shape.

A lower portion of the body may be fitted or coupled to the outlet of the oil gallery, and an upper portion of the body may be positioned within the oil gallery, so that the communication holes may directly communicate with the oil gallery in a radial direction of the oil gallery.

The structure may include a body, a guide part extending from the body, and a cover member moving along the guide part, and the guide part may have one or more communication holes directly communicating with the oil gallery.

The guide part may have an end wall on a top end thereof, and the end wall may directly face a top wall of the oil gallery so that the end wall of the guide part and the top wall of the oil gallery may define a shaking space to induce oil shaking.

As the piston moves in upward and downward directions, the cover member may move in a direction opposite to a movement direction of the piston so that the communication holes may be open and close by the cover member.

When the piston moves to a bottom dead center (BDC), the cover member may move to open the communication holes.

When the piston moves to a top dead center (TDC), the cover member may move to close the communication holes.

When the piston moves to the top dead center (TDC), the cover member may move to partially close the communication holes.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
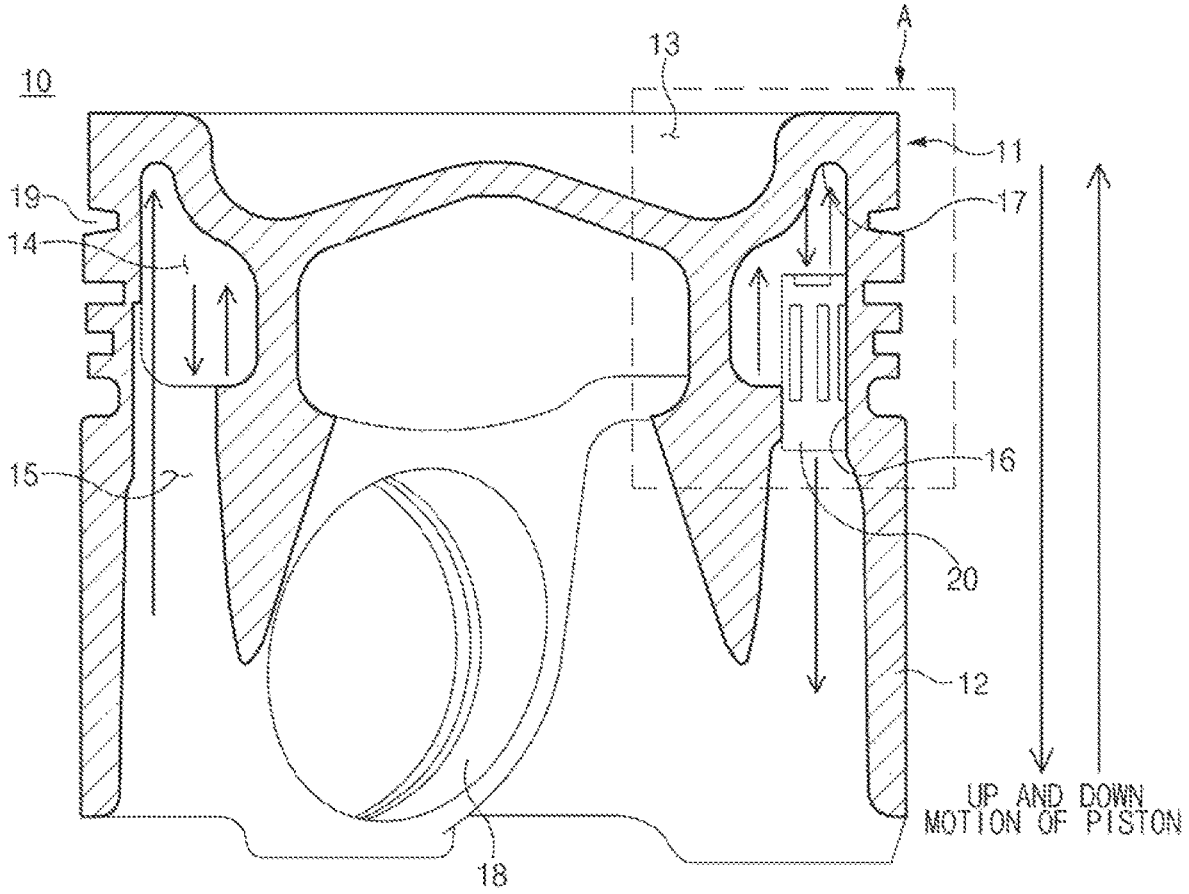
FIG. 1 illustrates a cross-sectional view of a piston for an internal combustion engine according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary forms of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIGS. 1 to 5, a piston 10 for an internal combustion engine according to an exemplary form of the present disclosure may include an oil gallery 14 through which oil circulates, and a structure 20 mounted at an outlet 16 of the oil gallery 14.

The piston 10 may include a crown 11 and a skirt 12. The crown 11 may have a combustion bowl 13 formed in a top surface thereof, and a plurality of ring grooves 19 formed in a circumferential surface thereof. Piston rings may be fitted into the ring grooves 19, respectively.

The skirt 12 may be extended from the crown 11, and have a piston bore 18 where a connecting rod is connected by a piston pin.

The oil gallery 14 may be formed to have an annular shape in a circumference direction of the piston 10 within the crown 11, and the oil gallery 14 may have an inlet 15 receiving oil injected by an oil jet 5 (see FIGS. 8 and 10) and the outlet 16 discharging the oil.

The oil may be introduced through the inlet 15, flow through the oil gallery 14, and be discharged through the outlet 16. As the piston 10 reciprocates up and down during the operation of the engine, the oil may be shaken up and down along an axial direction of the piston 10 in the oil gallery 14. That is, oil shaking may occur.

The structure 20 may have a body 21, and a plurality of communication holes 23 formed in a lateral wall of the body 21.

The body 21 may have a cylindrical shape corresponding to the shape of the outlet 16 of the oil gallery 14. The body 21 may have a hollow portion 21*a* formed therein, an end wall 22 formed on a top end thereof, and an opening 26 formed in a bottom end thereof.

For example, the lower lateral wall of the body 21 may be press-fit into the outlet 16 of the oil gallery 14. Alternatively, a screw tap may be formed on the lower lateral wall of the body 21, and the screw tap of the body 21 may be screwed to the outlet 16 of the oil gallery 14 so that the body 21 may be mounted at the outlet 16 of the oil gallery 14.

The plurality of communication holes 23 may be formed regularly or irregularly in the lateral wall of the body 21, and the plurality of communication holes 23 may communicate with the hollow portion 21*a* of the body 21. Thus, the oil may flow from the oil gallery 14 along the radius of the piston 10 through the plurality of communication holes 23, and be discharged through the hollow portion 21*a* of the body 21 and the opening 26 of the body 21. That is, each communication hole 23 may allow the oil to be discharged therethrough.

As the lower portion of the body 21 is fitted or coupled to an inner surface of the outlet 16 of the oil gallery 14, the upper portion of the body 21 may be inserted into the oil gallery 14, and thus the portion of the body 21 may be positioned within the oil gallery 14, and the communication holes 23 of the body 21 may directly communicate with the oil gallery 14 in a radial direction of the oil gallery 14.

As the portion of the body 21 is positioned within the oil gallery 14, the end wall 22 of the body 21 may directly face a top wall 17 of the oil gallery 14. In particular, the end wall 22 of the body 21 and the top wall 17 of the oil gallery 14 may face each other in the axial direction of the piston 10. Thus, a shaking space 50 may be created between the end wall 22 of the body 21 and the top wall 17 of the oil gallery 14. When the oil circulating through the oil gallery 14 is discharged through the outlet 16 of the oil gallery 14 during the operation of the engine, the oil introduced into the shaking space 50 may be blocked by the end wall 22 of the body 21 and the top wall 17 of the oil gallery 14 so that the oil may be shaken up and down. That is, when the oil is discharged through the outlet 16 of the oil gallery 14, oil shaking may be induced by the shaking space 50.

A recess 24 may be formed in the end wall 22 of the body 21. Since the volume of the shaking space 50 is increased by the recess 24, oil shaking may be induced more efficiently.

Figure 2:
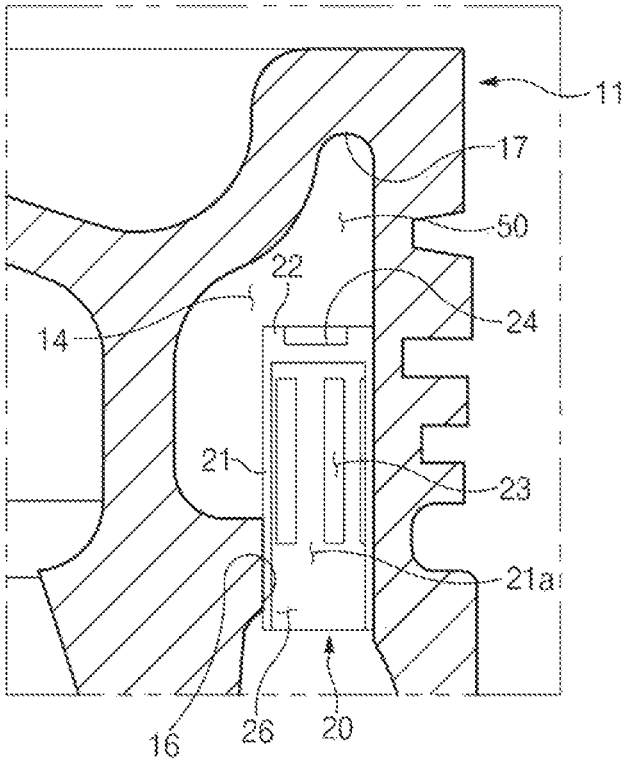
FIG. 2 illustrates an enlarged view of a portion indicated by arrow A of FIG. 1.
Figure 3:
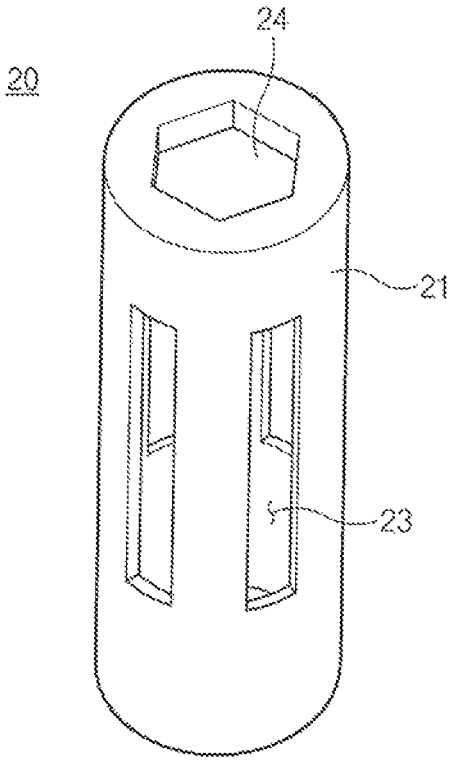
FIG. 3 illustrates a perspective view of a structure illustrated in FIG. 2.

According to an exemplary form, each communication hole 23 may have a slot shape extending in a length direction of the body 21 as illustrated in FIGS. 1 to 3. As the communication hole 23 is formed to have a slot shape, the discharge flow rate, velocity, and the like of the oil may be relatively increased.

Figure 4:
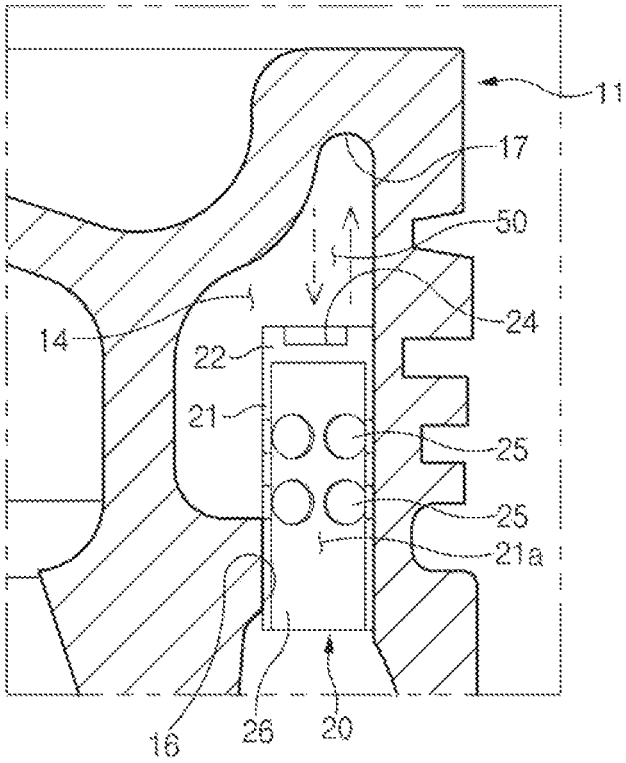
FIG. 4 illustrates an enlarged view according to a modified form of FIG. 2.
Figure 5:
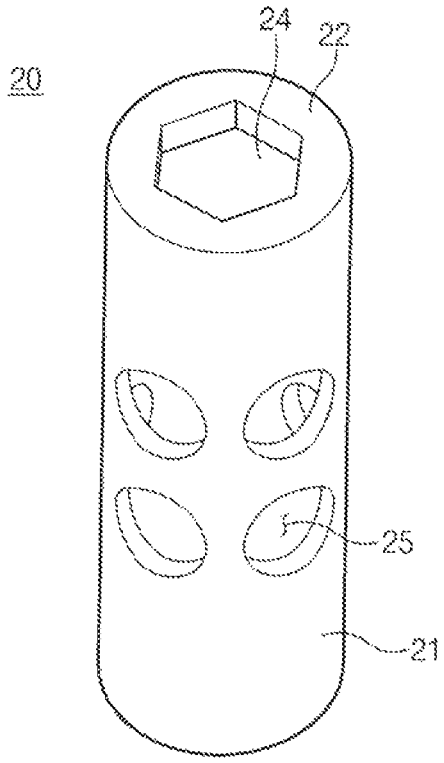
FIG. 5 illustrates a perspective view of a structure illustrated in FIG. 4.
Figure 6:
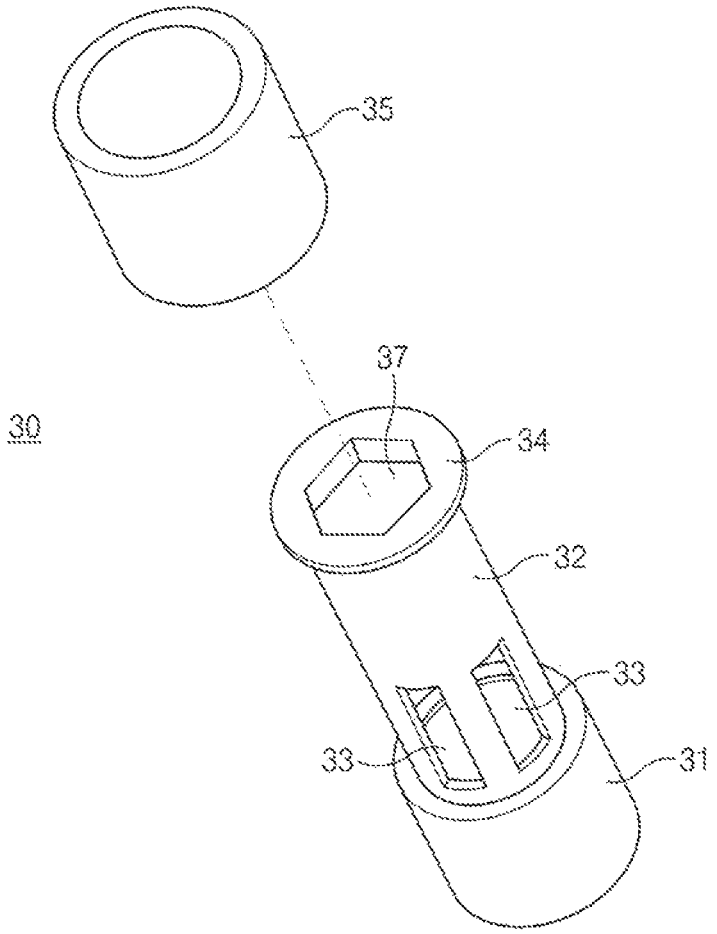
FIG. 6 illustrates an exploded perspective view of a structure according to another exemplary form of the present disclosure.
Figure 7:
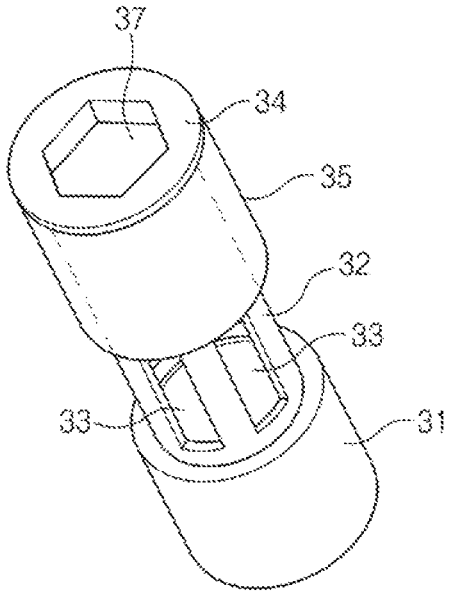
FIG. 7 illustrates a perspective view of a structure according to another exemplary form of the present disclosure.

According to another exemplary form, each communication hole 25 may have a circular shape as illustrated in FIGS. 4 and 5. As the communication hole 25 is formed to have a circular shape, the discharge flow rate, velocity, and the like of the oil may be relatively reduced.

The shape and size of the communication holes 23 and 25 may be determined to improve the oil flow rate, velocity, and the like in accordance with the specification of the piston.

In the above configuration, at least a portion of the oil flowing through the annular oil gallery 14 in the circumference direction of the piston 10 may be shaken up and down in the shaking space 50 formed above the outlet 16 of the oil gallery 14 so that oil shaking may be effectively induced at the outlet 16 of the oil gallery 14. Then, the oil may be discharged from the oil gallery 14 to the outside through the communication holes 23 and 25 of the structure 20, the hollow portion 21*a* and the opening 26 of the body 21.

Referring to FIGS. 6 to 11, a structure 30 according to another exemplary form of the present disclosure may include a body 31, a guide part 32 extending from the body 31, and a cover member 35 moving along the guide part 32.

The body 31 may have a cylindrical shape corresponding to the shape of the outlet 16 of the oil gallery 14. The body 31 may have a hollow portion 31*a* formed therein, and an opening 36 formed in a bottom end thereof. The body 31 may be mounted at the outlet 16 of the oil gallery 14. For example, a lateral wall of the body 31 may be press-fit into the outlet 16 of the oil gallery 14. Alternatively, a screw tap may be formed on the lateral wall of the body 31, and the screw tap of the body 31 may be screwed to the outlet 16 of the oil gallery 14 so that the body 31 may be mounted at the outlet 16 of the oil gallery 14.

The guide part 32 may have a hallow portion 32*a* formed therein, and an end wall 34 formed on a top end thereof. The hallow portion 31*a* of the body 31 and the hallow portion 32*a* of the guide part 32 may communicate with each other.

The guide part 32 may have an outer diameter smaller than an outer diameter of the body 31, and a plurality of communication holes 33 may be formed in a lateral wall of the guide part 32.

The plurality of communication holes 33 may be formed regularly or irregularly in the lateral wall of the guide part 32, and the plurality of communication holes 33 may communicate with the hallow portion 32*a* of the guide part 32 and the hallow portion 31*a* of the body 31. Thus, the oil may flow from the oil gallery 14 along the radius of the piston 10 through the plurality of communication holes 33, and be discharged through the hallow portion 32*a* of the guide part 32, the hallow portion 31*a* of the body 31, and the opening 36 of the body 31. That is, each communication hole 33 may allow the oil to be discharged therethrough.

The plurality of communication holes 33 may be formed in portions of the guide part 32 adjacent to the body 31. For example, the plurality of communication holes 33 may be formed in the lower lateral wall of the guide part 32, and the upper lateral wall of the guide part 32 may be entirely closed.

For example, each communication hole 33 may have a slot shape extending in a length direction of the guide part 32.

Alternatively, each communication hole 33 may have a circular shape as illustrated in FIGS. 4 and 5.

As the body 31 is mounted at the outlet 16 of the oil gallery 14, the guide part 32 may be inserted into the oil gallery 14, and thus the guide part 32 may be positioned within the oil gallery 14, and the communication holes 33 of the guide part 32 may directly communicate with the oil gallery 14 in the radial direction of the oil gallery 14.

As the guide part 32 is positioned within the oil gallery 14, the end wall 34 of the guide part 32 may directly face the top wall 17 of the oil gallery 14. In particular, the end wall 34 of the guide part 32 and the top wall 17 of the oil gallery 14 may face each other in the axial direction of the piston 10. Thus, a shaking space 60 may be created between the end wall 34 of the guide part 32 and the top wall 17 of the oil gallery 14. When the oil circulating through the oil gallery 14 is discharged through the outlet 16 of the oil gallery 14 during the operation of the engine, oil shaking may be induced by the shaking space 60.

A recess 37 may be formed in the end wall 34 of the guide part 32. Since the volume of the shaking space 60 is increased by the recess 37 formed in the end wall 34, oil shaking may be induced more efficiently.

According to an exemplary form, the cover member 35 may move along the guide part 32 to open and close the plurality of communication holes 33.

Figure 8:
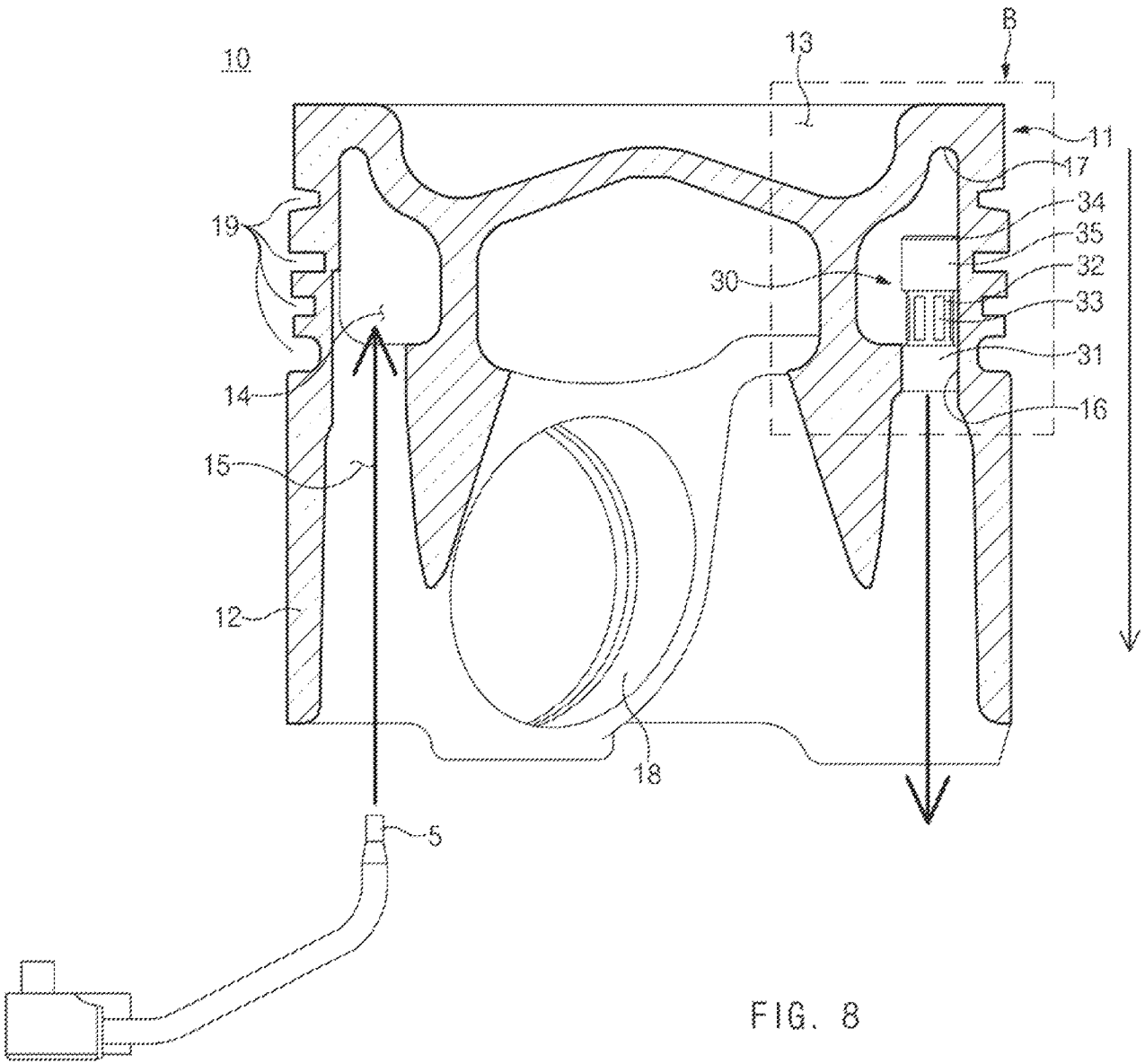
FIG. 8 illustrates a cross-sectional view of a piston for an internal combustion engine according to another exemplary form of the present disclosure, in a state in which the piston moves to bottom dead center (BDC)
Figure 9:
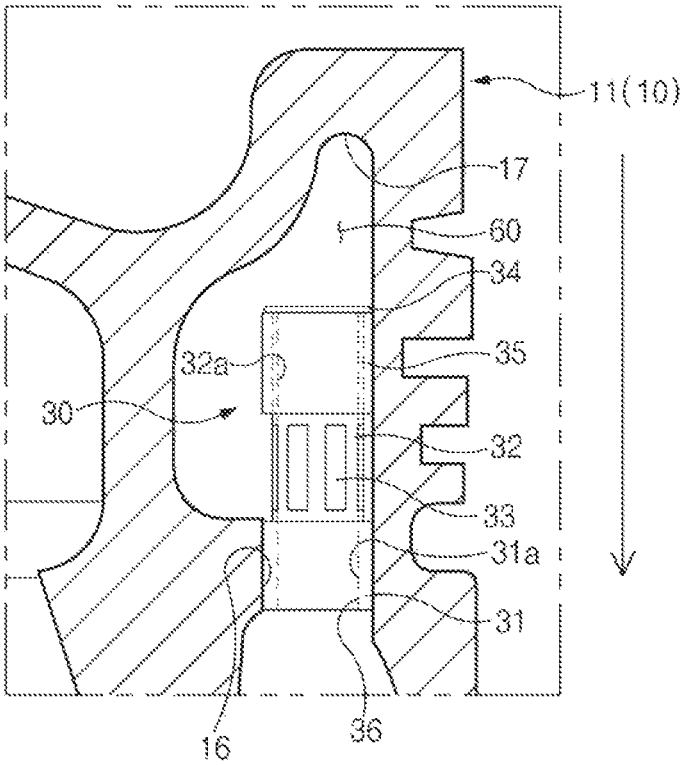
FIG. 9 illustrates an enlarged view of a portion indicated by arrow B of FIG. 8.

When the piston 10 moves to bottom dead center (BDC), a large amount of oil may flow into the inlet 15 of the oil gallery 14, and accordingly it may be desired to be discharged from the oil gallery 14. Referring to FIGS. 8 and 9, when the piston 10 moves down to BDC, the cover member 35 may move upwards by its reaction, and accordingly the cover member 35 may completely open the communication holes 33 of the guide part 32. Thus, the oil may be discharged from the oil gallery 14 to the outside through the open communication holes 33.

Figure 10:
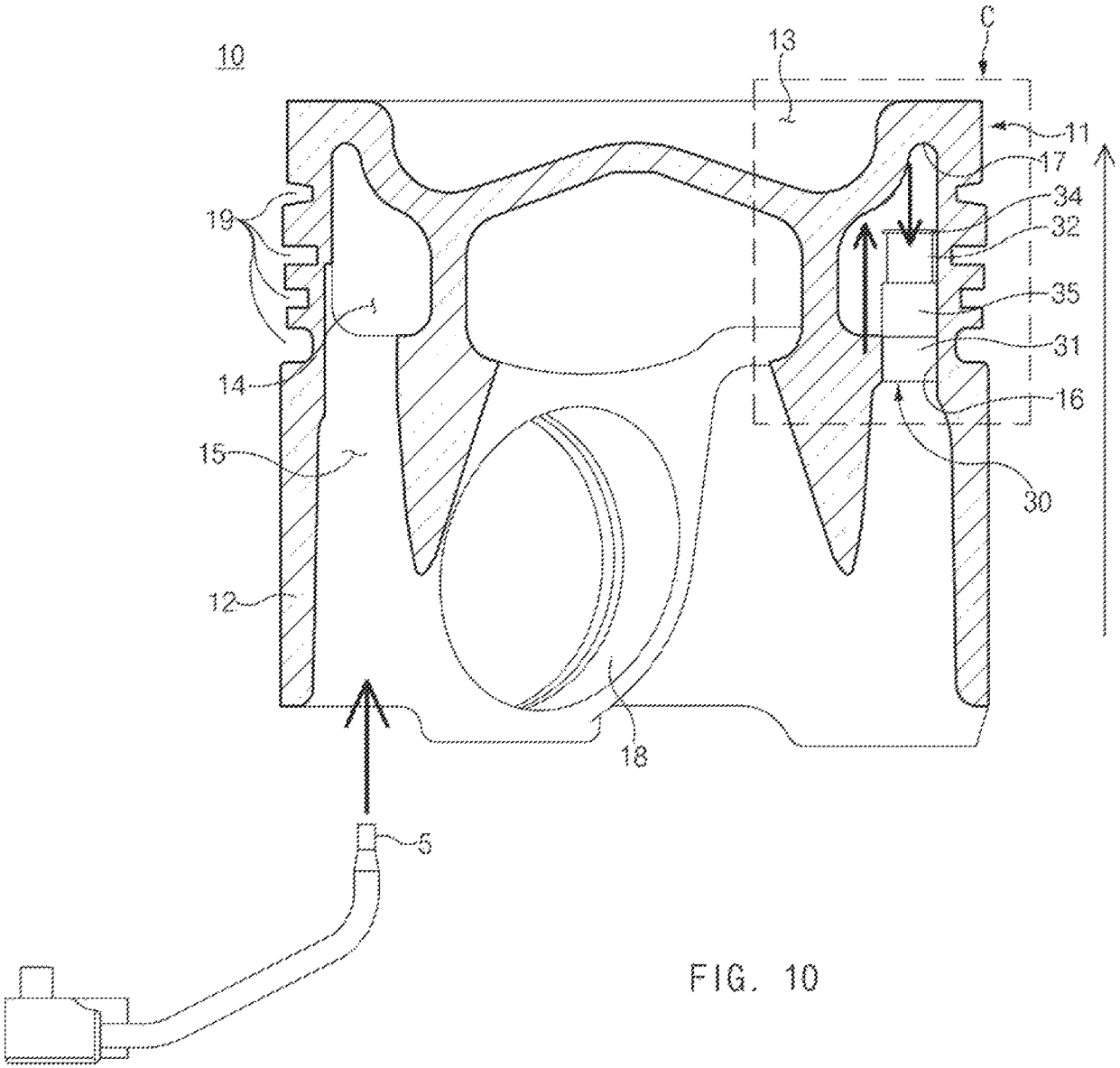
FIG. 10 illustrates a cross-sectional view of a piston for an internal combustion engine according to another exemplary form of the present disclosure, in a state in which the piston moves to top dead center (TDC)
Figure 11:
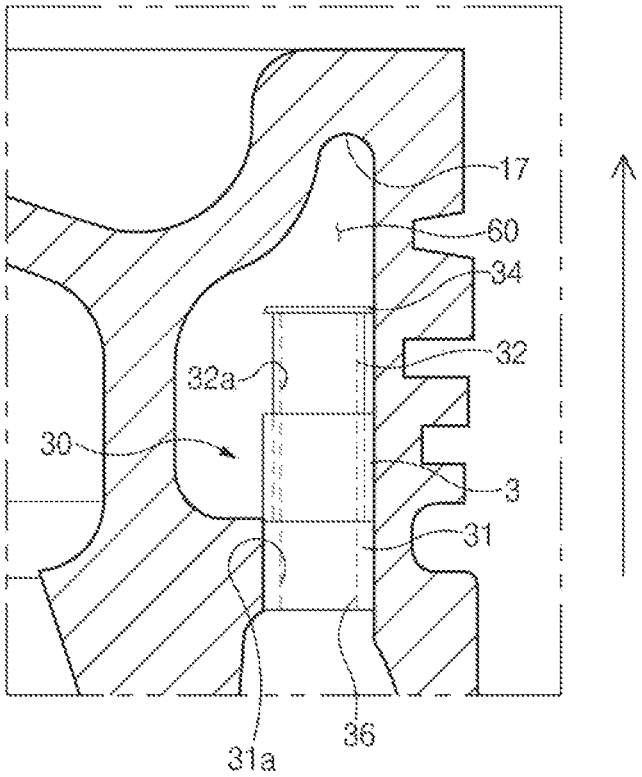
FIG. 11 illustrates an enlarged view of a portion indicated by arrow C of FIG. 10.

When the piston 10 moves to top dead center (TDC), a small amount of oil may flow into the inlet 15 of the oil gallery 14, and accordingly the oil may be prevented from being discharged from the oil gallery 14 or its discharge may be reduced or minimized. Referring to FIGS. 10 and 11, when the piston 10 moves up to TDC, the cover member 35 may move downwards by its reaction, and accordingly the cover member 35 may completely close the communication holes 33 of the guide part 32. Thus, the oil may be prevented from being discharged from the oil gallery 14 to the outside through the communication holes 33.

According to another exemplary form, when the piston 10 moves to TDC, the cover member 35 may partially close the communication holes 33. Thus, when the piston 10 moves to TDC, a minimum amount of oil may be discharged through the partially open communication holes 33.

In the above configuration, at least a portion of the oil flowing through the annular oil gallery 14 in the circumference direction of the piston 10 may be shaken up and down in the shaking space 60 formed above the outlet 16 of the oil gallery 14 so that oil shaking may be effectively induced at the outlet 16 of the oil gallery 14. When the piston 10 moves to BDC, that is, the amount of oil flowing into the oil gallery is relatively large, the cover member 35 may open the communication holes 33 of the guide part 32 to discharge the oil from the oil gallery. In addition, when the piston 10 moves to TDC, that is, the amount of oil flowing into the oil gallery is relatively small, the cover member 35 may completely or partially close the communication holes 33 of the guide part 32 to prevent the discharge of oil or discharge the minimum amount of oil.

As set forth above, the piston for an internal combustion engine according to exemplary forms of the present disclosure can induce the occurrence of oil shaking at the outlet side of the oil gallery during the operation of the engine, thereby improving cooling efficiency at the outlet of the oil gallery. Thus, the overall cooling performance of the piston can be improved, and durability of the piston can be increased.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. A piston for an internal combustion engine, the piston comprising: a crown; a skirt extending from the crown; an oil gallery extending annularly within the crown, and having an inlet and an outlet; and a structure mounted only at the outlet of the oil gallery and configured to induce oil shaking, wherein the structure has a body mounted at the outlet of the oil gallery, and a communication hole formed in a lateral wall of the body, wherein the communication hole is configured to allow oil to be discharged therethrough, wherein the body has an end wall on a top end thereof, and the end wall directly faces a top wall of the oil gallery so that a shaking space inducing oil shaking is defined between the end wall of the body and the top wall of the oil gallery, and wherein the end wall of the body has at least one recess.

2. The piston according to claim 1, wherein the communication hole has a slot shape extending in a length direction of the body.

3. The piston according to claim 1, wherein the communication hole has a circular shape.

4. The piston according to claim 1, wherein a lower portion of the body is fitted or coupled to the outlet of the oil gallery, and an upper portion of the body is positioned within the oil gallery, so that the communication hole directly communicates with the oil gallery in a radial direction of the oil gallery.

5. A piston for an internal combustion engine, the piston comprising: a crown; a skirt extending from the crown; an oil gallery extending annularly within the crown, and having an inlet and an outlet; and a structure mounted only at the outlet of the oil gallery and configured to induce oil shaking, wherein the structure includes a body, a guide part extending from the body, and a cover member moving along the guide part, and the guide part has at least one communication hole directly communicating with the oil gallery.

6. The piston according to claim 5, wherein the guide part has an end wall on a top end thereof, and the end wall directly faces a top wall of the oil gallery, wherein the end wall of the guide part and the top wall of the oil gallery define a shaking space configured to induce the oil shaking.

7. The piston according to claim 6, wherein as the piston moves in upward and downward directions, the cover member moves in a direction opposite to a movement direction of the piston so that the at least one communication hole is open and close by the cover member.

8. The piston according to claim 7, wherein when the piston moves to a bottom dead center (BDC), the cover member moves to open the at least one communication hole.

9. The piston according to claim 7, wherein when the piston moves to a top dead center (TDC), the cover member moves to close the at least one communication hole.

10. The piston according to claim 7, wherein when the piston moves to a top dead center (TDC), the cover member moves to partially close the at least one communication hole.

* * * * *